US007124725B2

(12) United States Patent
Kishimoto et al.

(10) Patent No.: US 7,124,725 B2
(45) Date of Patent: Oct. 24, 2006

(54) ENGINE SPARK PLUG GROUNDING STRUCTURE, GROUNDING WIRING APPARATUS, AND GROUNDING WIRING METHOD

(75) Inventors: Kiyoshi Kishimoto, Osaka (JP); Hiroshi Yamashita, Nagasaki (JP)

(73) Assignee: Audio-Labo Corporation, Isahaya (JP)

( * ) Notice: Subject to any disclaimer, the term of this patent is extended or adjusted under 35 U.S.C. 154(b) by 0 days.

(21) Appl. No.: 10/504,335

(22) PCT Filed: Dec. 24, 2002

(86) PCT No.: PCT/JP02/13412

§ 371 (c)(1),
(2), (4) Date: Apr. 22, 2005

(87) PCT Pub. No.: WO03/071127

PCT Pub. Date: Aug. 28, 2003

(65) Prior Publication Data

US 2005/0206288 A1 Sep. 22, 2005

(30) Foreign Application Priority Data

Feb. 25, 2002 (JP) ..... 2002-047896
Nov. 12, 2002 (JP) ..... 2002-328472

(51) Int. Cl.
*H01T 13/04* (2006.01)

(52) U.S. Cl. ..... 123/169 PA; 123/169 R

(58) Field of Classification Search ..... 123/634, 123/635, 647, 169 R, 169 CB, 169 DW, 123/169 EL, 169 EB, 143 C, 169 PA, 169 PH
See application file for complete search history.

(56) References Cited

U.S. PATENT DOCUMENTS 893,955 A * 7/1908 Woert ..... 313/143

(Continued)

FOREIGN PATENT DOCUMENTS

| | | |
|---|---|---|
| JP | 59-177882 | 10/1984 |
| JP | 5-256241 | 10/1993 |
| JP | 9-32713 | 2/1997 |

*Primary Examiner*—Hai Huynh
(74) *Attorney, Agent, or Firm*—Oblon, Spivak, McClelland, Maier & Neustadt, P.C.

(57) ABSTRACT

A grounding member made of a spring steel includes a hexagonal top with a through hole, contact pieces extending from straight sides of the hexagonal top, and a grounding strip brazed to one of the contact pieces. The grounding member attaches to a spark plug with a spark plug insulator passing through the through-hole. The contact pieces pressure contact a peripheral surface of a hexagonal nut of the spark plug. A grounding wire is connected to a negative electrode of a battery. Electric charges generated in a spark gap are returned to the battery negative electrode from an external electrode of the spark plug via a spark plug housing, the grounding member, and the grounding wire. If the spark plug is loosely fitted in an engine cylinder head, or even if some engine body components are aged, electric charges flow without problems, preventing reduction of discharging performance.

10 Claims, 7 Drawing Sheets

U.S. PATENT DOCUMENTS 1,413,142 A * 4/1922 Thayer ..... 313/121
1,596,685 A * 8/1926 Reardon ..... 313/121
2,409,732 A * 10/1946 Browne et al. ..... 439/126
2,768,227 A * 10/1956 Ruckelshaus ..... 123/633
3,293,352 A * 12/1966 Livingston ..... 174/35 SM
4,159,441 A * 6/1979 Livingston ..... 315/85
5,180,313 A * 1/1993 Brandt ..... 439/125
6,360,706 B1 * 3/2002 Skinner et al. ..... 123/169 PH
2005/0224033 A1 * 10/2005 Linkenhoger ..... 123/169 R
2006/0162685 A1 * 7/2006 Cheng ..... 123/169 R

* cited by examiner (a)

(b)

ENGINE SPARK PLUG GROUNDING STRUCTURE, GROUNDING WIRING APPARATUS, AND GROUNDING WIRING METHOD

FIELD OF THE INVENTION

The present invention relates to a grounding structure for a spark plug of an engine driven by fuel such as gasoline or liquefied petroleum gas (LPG), a ground wiring device, and a method of wiring the grounding structure.

BACKGROUND OF THE INVENTION

Usually, in an engine driven by gasoline, liquefied petroleum gas or the like, the compressed air-fuel mixture is fired by electric sparks generated by an ignition system. The ignition system is either a contacting type (electric type) or non-contacting type (electronic type), and generates electric sparks using a spark plug in response to high pressure applied from an ignition coil, thereby firing the air-fuel mixture.

FIG. 7(*a*) of the accompanying drawings shows an external appearance of a spark plug 10, and FIG. 7(*b*) is a cross section of the spark plug installed in a cylinder head H of an engine with inner parts.

Referring to those figures, the spark plug 10 includes a center electrode 2 axially housed in a cylindrical insulator 1. The center electrode 2 has one end sticking out via a bottom opening of the insulator 1. High pressure is generated by the ignition coil between positive and negative electrodes of a battery (not shown), and is applied between the sticking-out end of the center electrode 2 and to one end of an external electrode 3.

A lower half of the insulator 1 is enclosed in a spark plug housing 4, of which lower peripheral surface is a male-screwed part 4*b*. The spark plug 10 is fitted into a cylinder head H of the engine via the male-screwed part 4*b*. The lower end of the center electrode 2 comes out via a bottom opening of the male-screwed part 4*b*. The external electrode 3 is attached around a lower periphery of the male-screwed part 4*b*, and has its end facing with the lower end of the center electrode 2. Discharges are caused in a spark gap G between the end of the external electrode 3 and the end of the center electrode 2. The spark gap G faces with a combustion chamber of the engine.

An upper end of the center electrode 2 is connected to a terminal nut 5 fixedly fitted in an upper opening of the insulator 1. A high pressure cord C extends from an ignition coil connected to the positive electrode of the battery, and is connected to the terminal nut 5 via a cap 6.

Electric charges emitted in the spark plug gap G return to the negative electrode 11 of the battery from the external electrode 3 via the spark plug housing 4, the cylinder head H of the engine, an engine body, a chassis of the vehicle where the engine body is mounted, and so on. The electric charges tend to sluggishly flow while they pass over a long range through a number of contacts, engine body, chassis and so on.

Further, sometimes the spark plug 10 is loosely attached in the cylinder head H (i.e. at the male-screwed part 4*b* of the spark plug housing 4), or there are poor conductions caused by aged components of the engine body. In such a case, electric charges tend to flow non-smoothly, which will worsen the discharge performance. The lower the discharge performance, the weaker firing force, and the lower fuel efficiency. Further, engine torque characteristics will be worsened.

In the former case, the spark plug 10 is vibrated each time sparks are generated in order to fire the air-fuel mixture, so that the connection becomes slack between the spark plug 10 and the cylinder head H. In the latter case, engine components are always exposed to intense heat, and will be inevitably aged.

The invention has been contemplated in order to overcome problems of the related art, and to provide a grounding structure which can remove factors causing reduced discharge performance, enable electric charges to be effectively returned to a negative electrode of the battery, and to improve the fuel efficiency and engine torque characteristics.

SUMMARY OF THE INVENTION

In order to accomplish the foregoing object, the invention proposes a grounding member which is attached to a spark plug housing, and is connected to a negative electrode of a battery using a grounding wire.

The grounding member enables electric charges generated by discharging to return to the negative electrode of the battery from the spark plug housing via the grounding wire. Even if the spark plug happens to be loosely attached to the engine body, or even if some engine components are aged, the electric charges can flow without any inconvenience, which is effective in preventing the discharge performance from being lowered. The thermal efficiency of the engine at the time of ignition can be improved, and fuel efficiency and torque characteristics will be better than those of the related art.

The grounding member is shaped to be engagebale with or disengagebale from a hexagonal nut of the spark plug housing, and can be easily attached to and detached from the spark plug only by removing a cap of a high pressure cord without using a special tool or skill.

The grounding member includes a hexagonal top of which size and shape are substantially identical to those of the hexagonal nut of the spark plug housing. The hexagonal top has a through-hole at the center thereof, and contact pieces extending from the six straight sides thereof. When attached onto the hexagonal nut, the grounding member has its contact pieces brought into pressure contact with the peripheral surface of the hexagonal nut due to resiliency.

Alternatively, the hexagonal top may have a through-hole at the center thereof, and three contact pieces extending from every two straight sides thereof. When attached onto the hexagonal nut, the grounding member has its contact pieces brought into pressure contact with the peripheral surface of the hexagonal nut due to resiliency.

The grounding member preferably has contact pieces in contact with the peripheral surface of the hexagonal nut, a through-hole via which an insulator of the spark plug passes, and a grounding strip sticking out of an engine cylinder head.

Therefore, the grounding member can be attached to the spark plug which has been installed in the engine cylinder head. In this state, the insulator passes through the through-hole of the grounding member, and the contact pieces extend over the hexagonal nut of the spark plug housing, and are in pressure contact with the peripheral surface of the hexagonal nut.

Some spark plug is deeply embedded in the cylinder head. In such a case, the grounding member has the grounding strip extending out of the engine cylinder head, which facilitates the connection between the grounding strip and the grounding wire.

BRIEF DESCRIPTION OF THE DRAWINGS

FIG. 1(*b*) is a cross section of the spark plug.

FIG. 6(*b*) schematically shows patterns for punching a metal plate to make grounding members each having six contact pieces.

FIG. 7(*b*) is a cross section of the spark plug of FIG. 7(*a*), with internal components mounted.

BEST MODE FOR EMBODYING THE INVENTION

Figure 1:
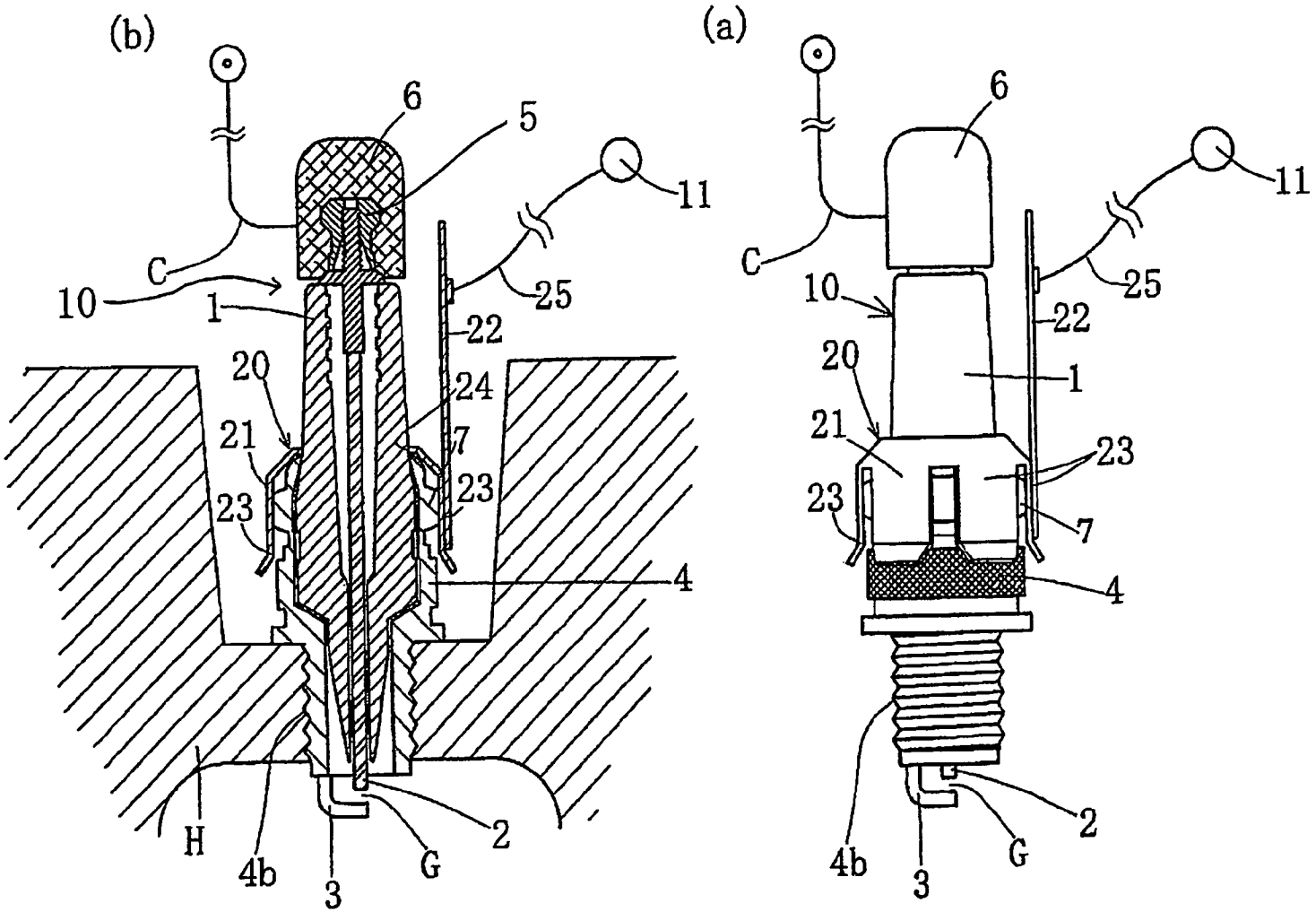
FIG. 1(*a*) shows an external appearance of a spark plug with a grounding member attached thereto in one embodiment of the invention.

The invention will be described with reference to one embodiment shown in the drawings.

Figure 7:
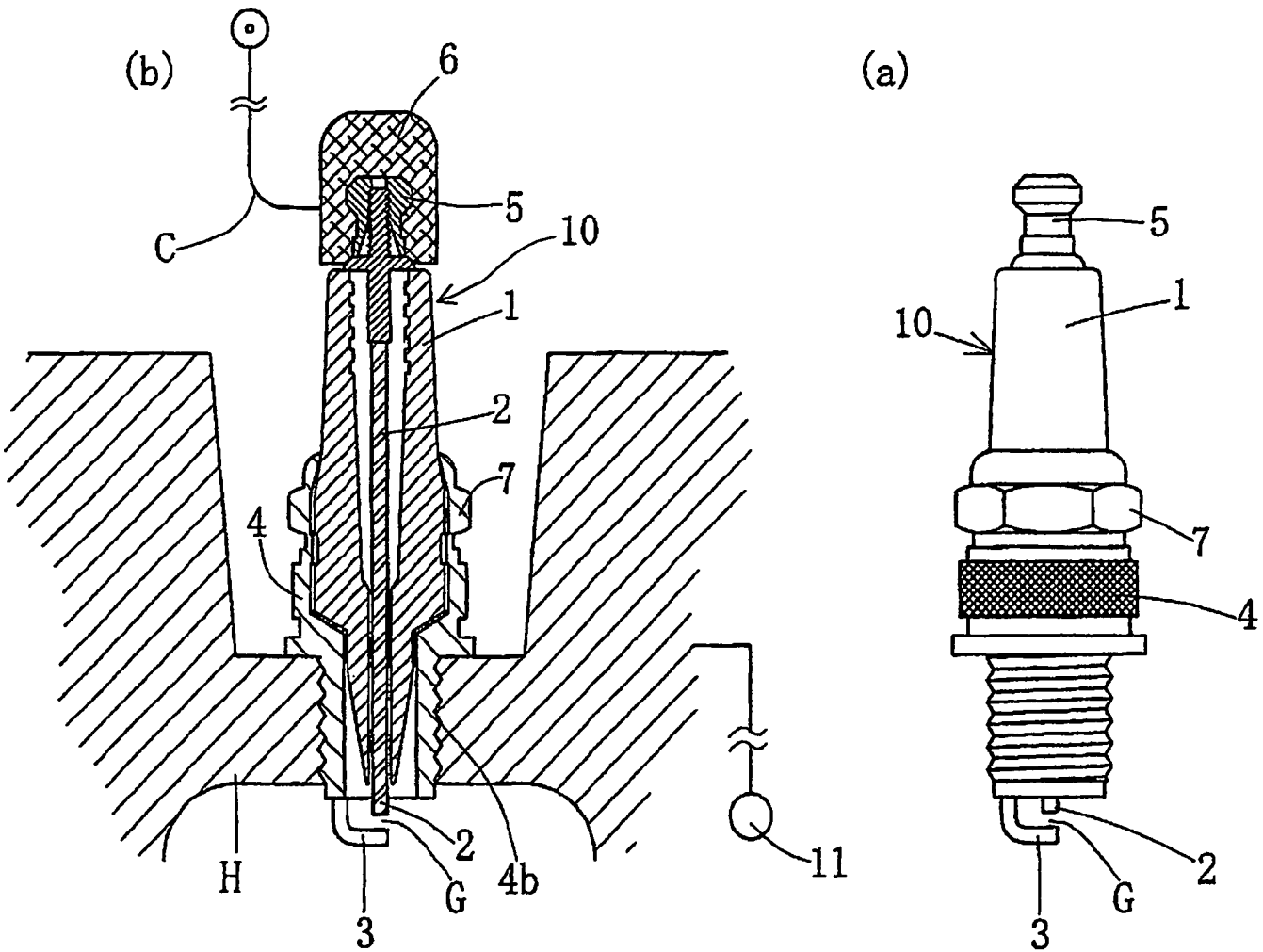
FIG. 7(*a*) shows an external appearance of an existing spark plug.

In the drawing figures, like or corresponding parts are denoted by like or corresponding reference numerals to those shown in FIG. 7(*a*) and FIG. 7(*b*).

Figure 2:
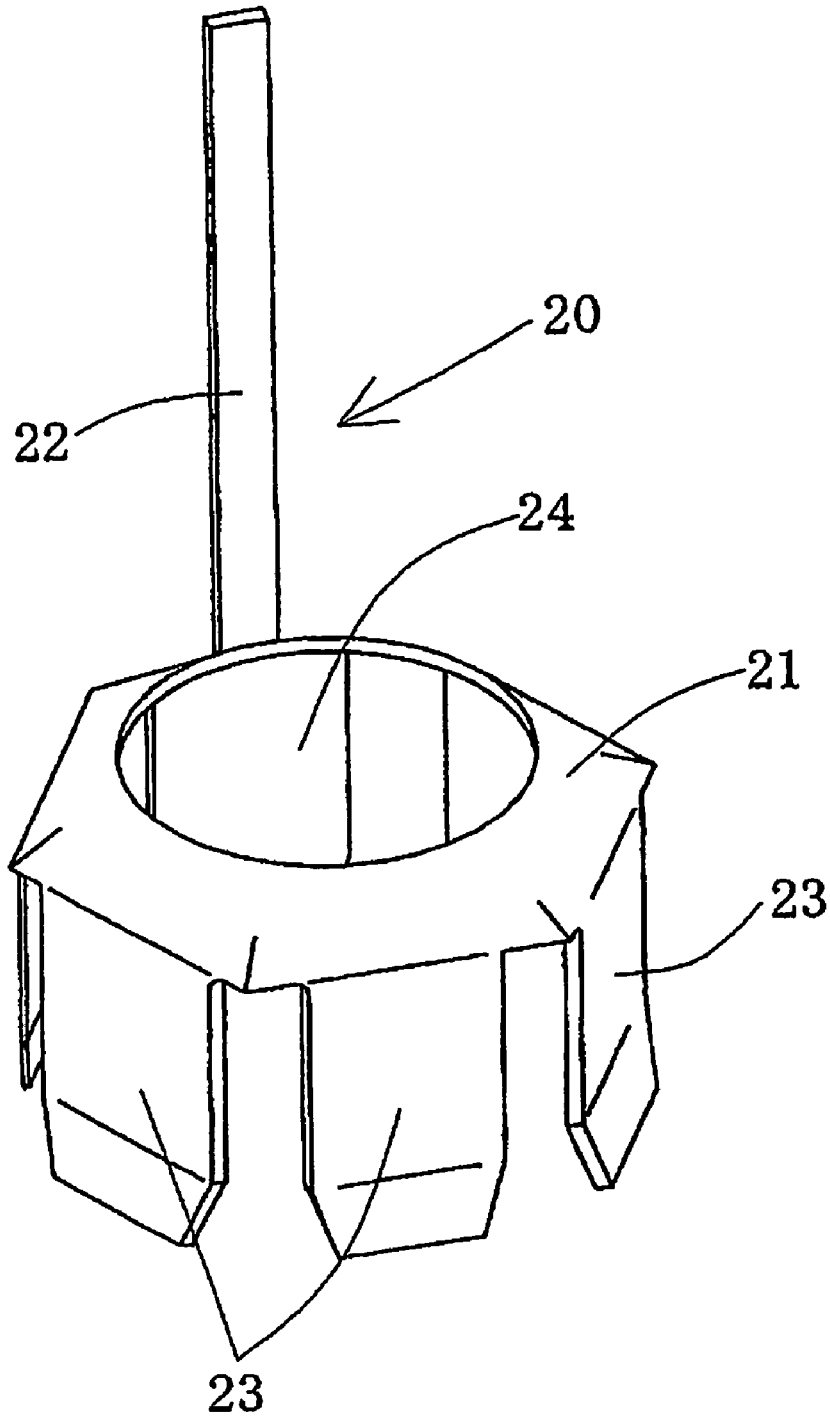
FIG. 2 is a perspective view of the grounding member of the first embodiment.

A spark plug 10 is configured and is attached to an engine cylinder head H similarly to the spark plug shown in FIGS. 7(*a*) and 7(*b*), and will not be described here. FIG. 2 shows a grounding member 20 attached to the spark plug 10 in the embodiment.

The grounding member 20 is made of spring steel, and includes a hexagonal top 21 in the shape of a cap, and a grounding strip 22 as shown in FIG. 2. The hexagonal top 21 has six rectangular contact pieces 23 (called the "contact pieces") extending from the six straight sides thereof. The grounding strip 22 is brazed onto one of the contact pieces 23. Adjacent contact pieces 23 are spaced from each other. The six contact pieces 23 are radially extendable due to their resiliency and the spaces therebetween. The hexagonal top 21 has a perfectly circular through-hole 24 at the center, and is fitted onto a hexagonal nut 7 of the spark plug 10 from above an upper end of an insulator 1, so that the contact pieces 23 come into pressure contact with the peripheral surface of the hexagonal nut 7. In this state, the insulator 1 extends through the circular through-hole 24 of the cap-shaped body 21.

The grounding strip 22 is brazed onto one of the contact pieces 23, and stands upright. Referring to FIG. 1(*b*), the grounding strip 22 sticks out of the cylinder head H.

The grounding member 20 is attached to the spark plug 10 installed in the cylinder head H as shown in FIGS. 1(*a*) and 1(*b*). In short, the grounding member 20 is attached onto the spark plug 10, so that the grounding member 20 is pressed toward the peripheral surface of the hexagonal nut 7 by the resilience of the contact pieces 23. In this state, a cap 6 positioned near the high pressure cord C has been detached. The high pressure cord C extends from the ignition coil connected to the positive electrode of the battery.

The grounding member 20 can be easily attached to and detached from the spark plug 10 simply by removing the cap 6 of the high pressure cord, without using any special tool or skill.

The grounding strip 22 sticking out of the cylinder head H can be easily connected to a grounding wire 25, the end of which is connected to a negative electrode 11 of the battery.

The foregoing structure allows electric charges (generated in the spark gap G due to discharging) to return to the negative electrode 11 of the battery via the external electrode 3, spark plug housing 4, grounding member 20, and grounding wire 25. Even if there is a gap between the spark plug 10 and the cylinder head H, or even if some engine components are aged, electric charges can flow without any problem, which is effective in preventing the discharging performance from being adversely affected.

The grounding member 20 prevents lowering of the discharge performance of the spark plug 10 for reasons which are familiar with the related art. Therefore, the spark plug 10 provided with the grounding member 20 promotes efficient ignition of air-fuel mixture, and improves thermal efficiency, fuel consumption and torque characteristics of the engine.

FIG. 1(*b*) shows the spark plug 10 having its head sticking out of the cylinder head H. Alternatively, the spark plug 10 may be embedded in the cylinder head H, and the grounding strip 22 protrudes out of the cylinder head H as shown in FIG. 3.

Figure 3:
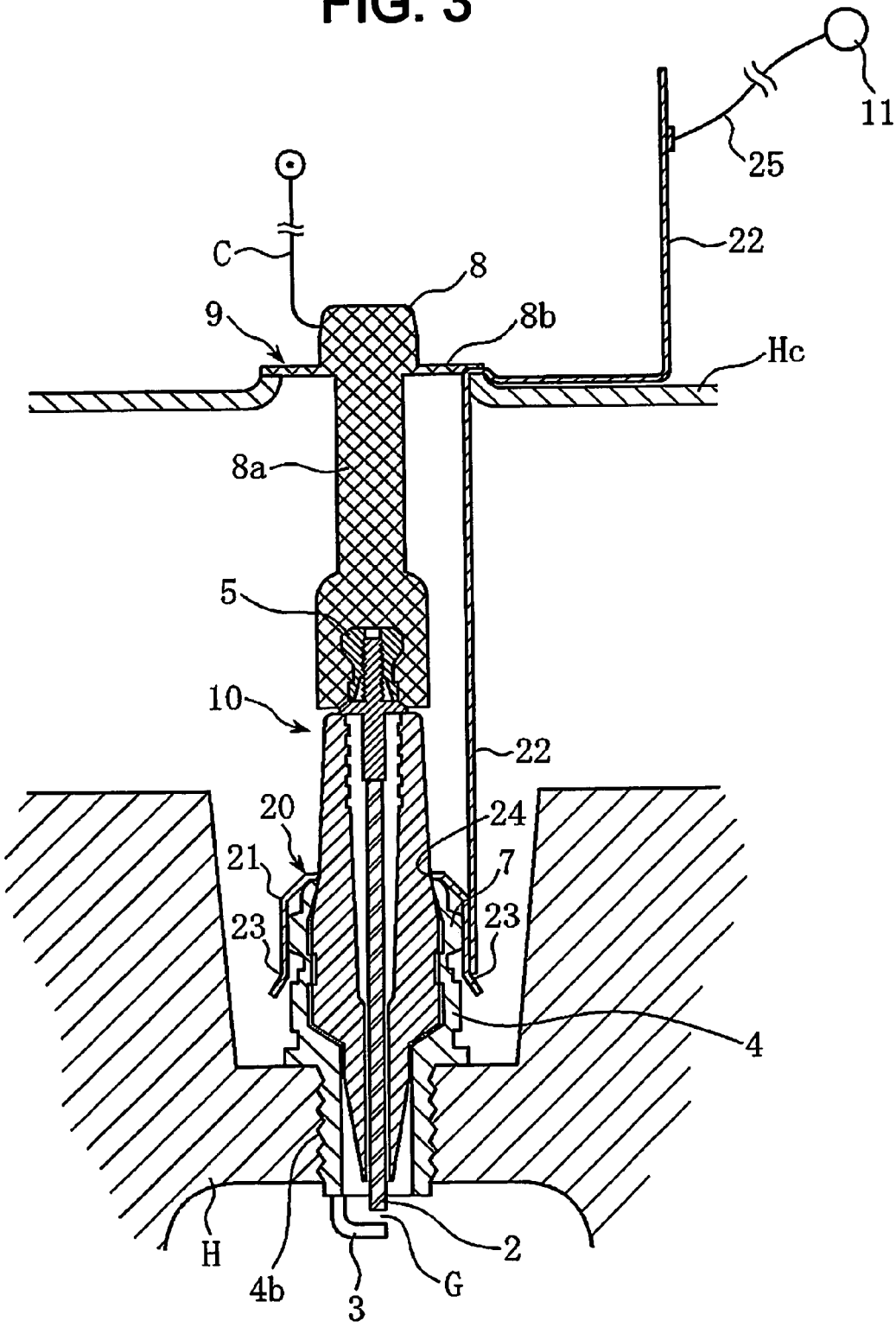
FIG. 3 is a cross section of a modified example of the embodiment.

Referring to FIG. 3, the spark plug 10 is installed deep in the cylinder head H which has a head cover Hc. A cap 8 includes a body 8*a*, and an umbrella 8*b* covering an opening 9 of the head cover Hc. The body 8*a* extends from the opening 9 to a terminal nut 5 of the spark plug 10.

The grounding strip 22 extends upward from one of the contact pieces 23 to the umbrella 8*b* through a gap defined by the cylinder head H and the cylinder head cover Hc, and projects out of the cylinder head cover Hc. This structure facilitates a connection between the grounding strip 22 and the grounding wire 25. The grounding member 20 can be easily attached or detached only by removing the cap 8.

The invention is applied to the electric igniter in the embodiment. Alternatively, the invention is also applicable to an electronic igniter (constituted by a long life transistor), which is effective in improving the reliability of the igniter and meeting requirements for emission limit.

Figure 4:
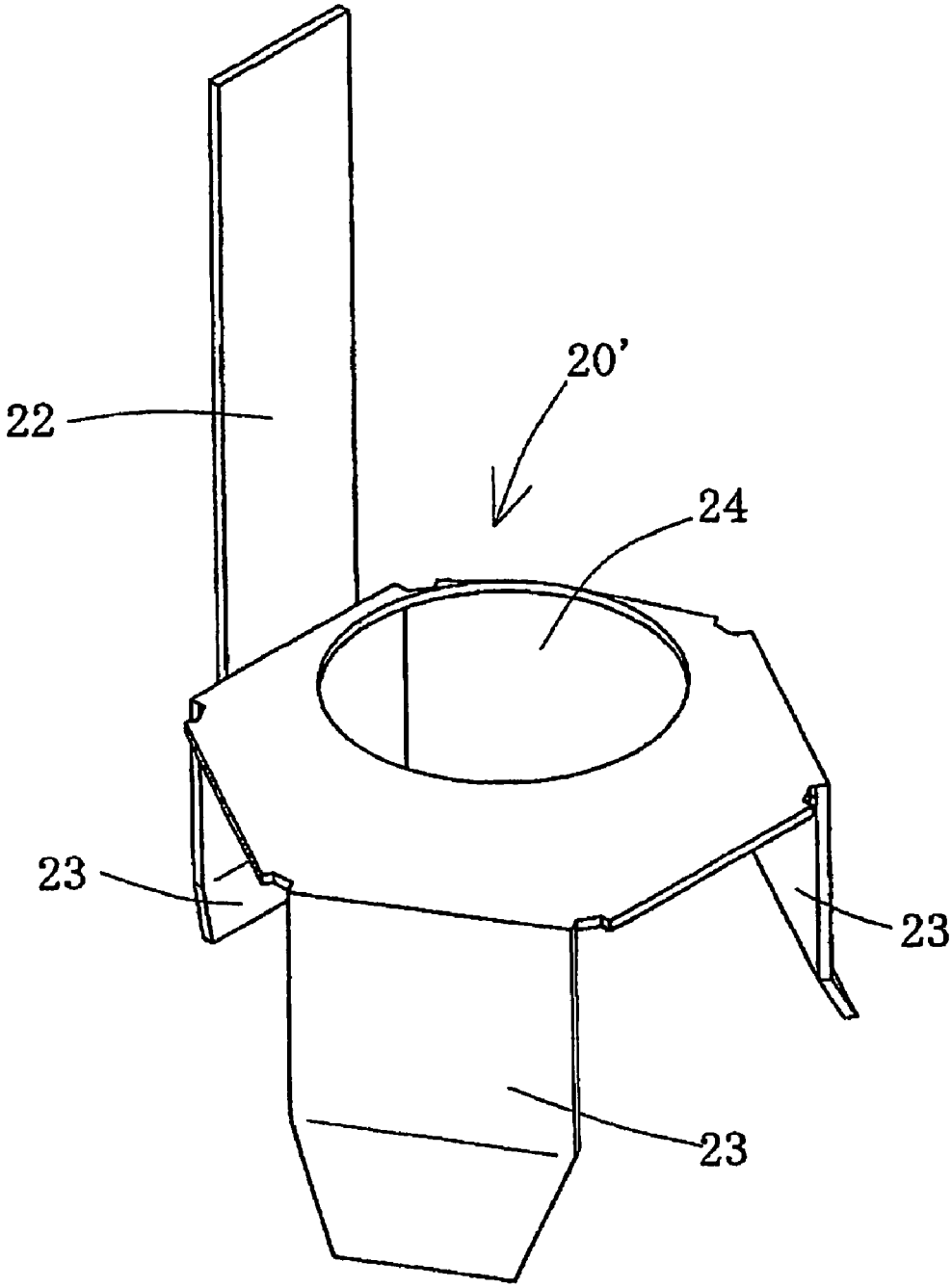
FIG. 4 is a perspective view of a further grounding member.
Figure 5:
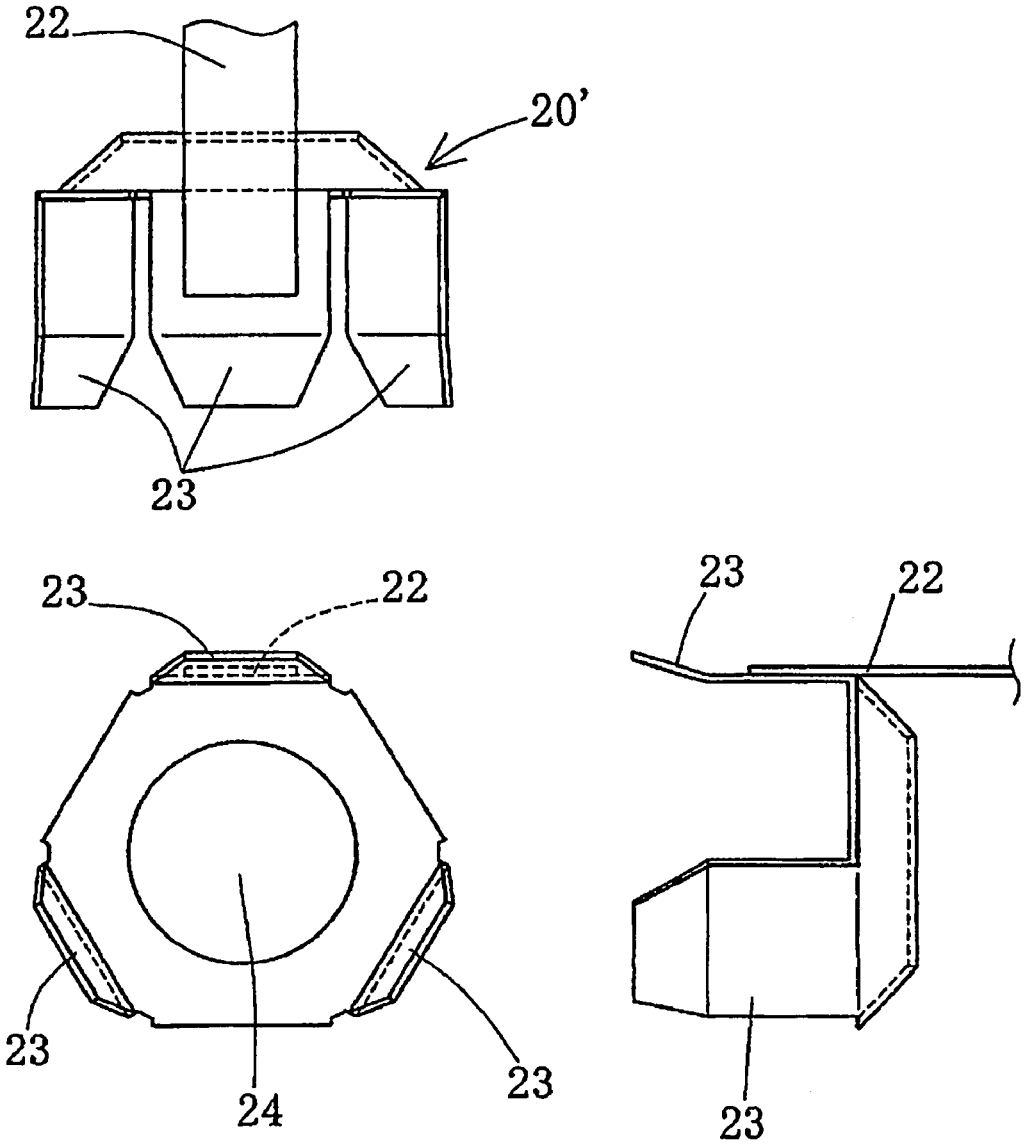
FIG. 5 shows a top plan view, a side elevation, and a front sectional views of the grounding member of FIG. 4.

In the embodiment, the grounding member 20 includes the hexagonal top 21, which has the six contact pieces 23. The contact pieces 23 extend from the six straight sides of the hexagonal top 21, and are engageable with the side surfaces of the hexagonal nut. Alternatively, a grounding member 20' may include three contact pieces 23 which extend from every other straight side of the hexagonal top 21 as shown in FIG. 4 and FIG. 5. The 3-contact-piece structure is advantageous in the following respect when compared with the 6-contact-piece structure.

Figure 6:
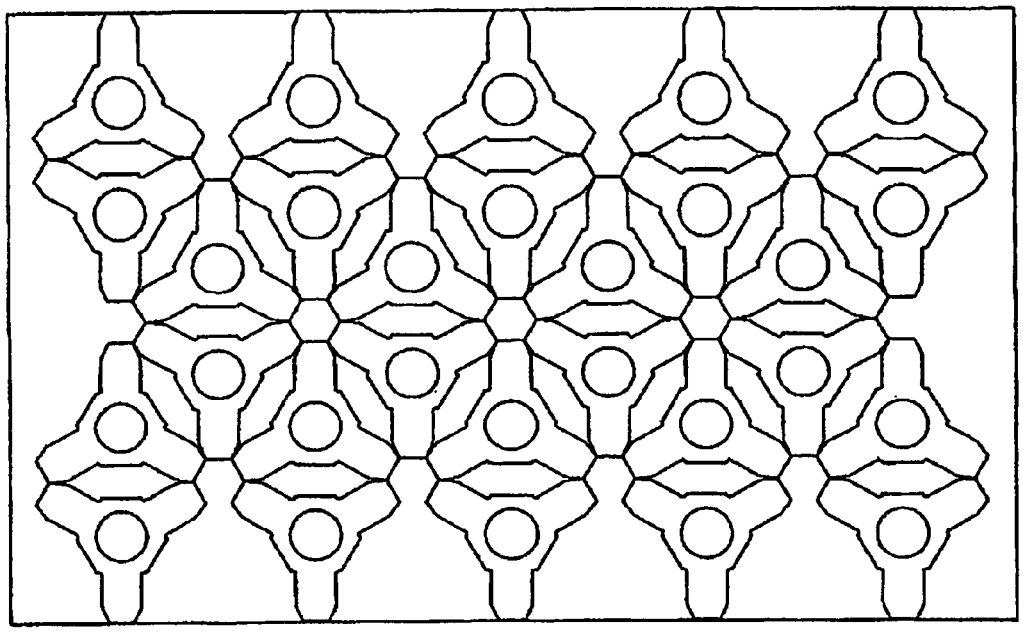
FIG. 6(*a*) schematically shows patterns for punching a metal plate to make grounding members each having three contact pieces.
Figure 6:
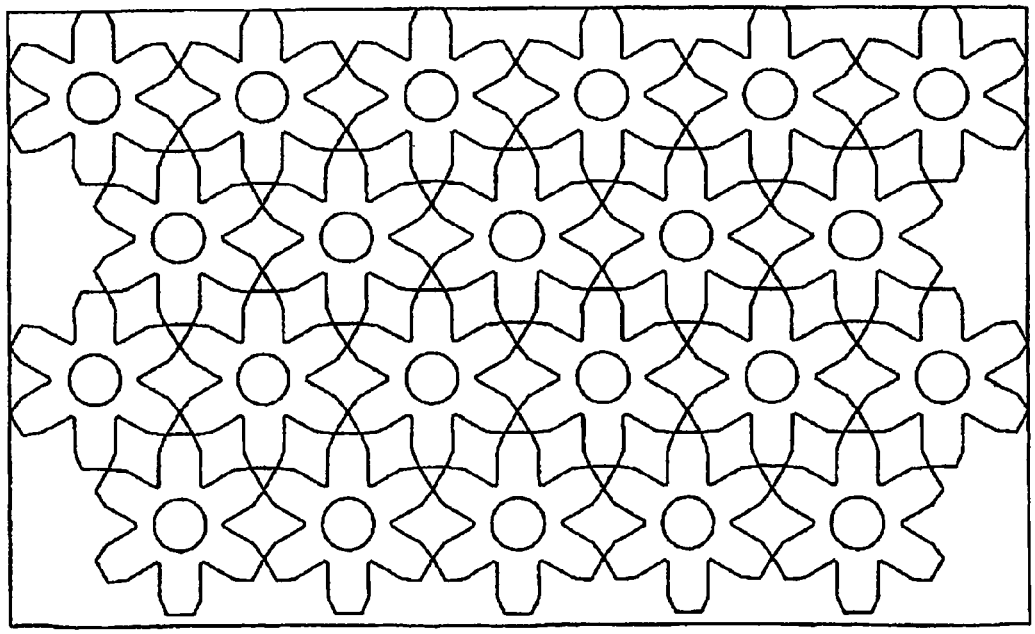

The grounding members 20 of the 3-contact-piece type and those of the 6-contact-piece type (shown in FIGS. 2 and 4) are made as follows. The tops having the contact pieces are punched out of a metal plate. Thereafter, the contact pieces are folded along the six straight sides of the top. FIG. 6(*a*) shows the arrangement of the 3-contact-piece type tops on the metal plate while FIG. 6(*b*) shows the arrangement of the 6-contact-piece type tops on the metal plate. In the former case, every adjacent pairs of the 3-contact-piece type tops can be arranged with a small gap therebetween, which is effective in saving the metal plate (i.e. resources).

The spring steel is employed in order to make the grounding members 20. Alternatively, stainless steel plates, nonferrous metal such as phosphor bronze, and so on for making springs are also usable.

An electrostatic potential is generated in the combustion chamber with which the spark gap G of the spark plug 10 faces when the air-fuel mixture is injected into the combustion chamber or when the combustion chamber is rubbed by the compressed air-fuel mixture. The electrostatic potential adversely affects discharges generated in the spark plug G. The grounding member 20 can effectively lead such an electrostatic potential from the combustion chamber to the negative electrode 11 of the battery via the external electrode 3 and the housing 4, thereby quickly equalizing potentials at the external electrode 3 and the negative electrode 11. Therefore, an essential potential difference for discharging can be applied into the spark gap G, which enables the air-fuel mixture to be efficiently ignited.

Especially, in the case of the electronic type igniter, a predetermined potential difference is usually applied between the center and external electrodes 2 and 3 under the electronic control. If the electrostatic potential is generated in the combustion chamber, sometimes the predetermined potential difference cannot be applied. However, the grounding member 20 of the invention can speedily equalize the external electrode 3 and the negative electrode 11, and lead to effective ignition of the air-fuel mixture.

The grounding member 20 and grounding strip 22 are preferably made of brass, copper, silver or the like having high conductivity. Especially, silver is six times as conductive as iron used for the engine body or the like. The grounding member 20 made of silver assures several to several ten times effective grounding performance compared with a grounding member made of another metal. Further, the silver grounding member 20 can assure the predetermined potential difference in the spark plug G several to several ten times as quickly, and enable the air-fuel mixture to be efficiently ignited.

The grounding member can prevent reduction of the discharging performance of the spark plug, and improve thermal efficiency at the time of ignition, and fuel consumption and torque characteristics of the engine.

INDUSTRIAL APPLICABILITY OF THE INVENTION

The grounding member and grounding strip, and connecting method of the grounding strip of the invention are applicable to engines using gasoline or liquefied petroleum gas as fuel in vehicles, ships, electric generators and so on.

What is claimed is:

1. A grounding structure for a spark plug which generates electric discharges between a center electrode and an external electrode and is attached to an engine cylinder head via a screwed part of a spark plug housing near the external electrode, the grounding structure comprising:

a grounding member shaped to be engageable with and disengageable from a hexagonal nut of the spark plug housing, and connected to a negative electrode of a battery using a grounding wire, wherein the grounding member includes a hexagonal top whose shape and size are substantially identical to those of the hexagonal nut, the hexagonal top having a through-hole at a center thereof for the spark plug housing, and contact pieces extending from every two straight sides thereof.

2. The grounding structure of claim 1, wherein the grounding member includes contact pieces engageable with a peripheral surface of the hexagonal nut, a through-hole via which an insulator of the spark plug passes, and a grounding strip extending out of the engine cylinder head.

3. A grounding structure for a spark plug which generates electric discharges between a center electrode and an external electrode and is attached to an engine cylinder head via a screwed part of a spark plug housing near the external electrode, the grounding structure comprising:

a grounding member shaped to be engageable with and disengageable from a hexagonal nut of the spark plug housing, and connected to a negative electrode of a battery using a grounding wire, wherein the grounding member includes a hexagonal top which has a shape and size substantially identical to those of the hexagonal nut, the hexagonal top having a through-hole at a center thereof for the spark plug housing, and is provided with contact pieces extending from six straight sides thereof.

4. The grounding structure of claim 3, wherein the grounding member includes contact pieces engageable with a peripheral surface of the hexagonal nut, a through-hole via which an insulator of the spark plug passes, and a grounding strip extending out of the engine cylinder head.

5. A ground wiring device for a spark plug which generates electric discharges between a center electrode and an external electrode and is attached to an engine cylinder head via a screwed part of a spark plug housing near the external electrode, the ground wiring device comprising:

a grounding member attached to a spark plug housing and shaped to be engageable with and disengageable from a hexagonal nut of the spark plug housing; and a grounding wire connecting the grounding member to a negative electrode of a battery, wherein the grounding member includes a hexagonal top whose shape and size are substantially identical to those of the hexagonal nut, the hexagonal top having through-hole at a center thereof for the spark plug housing, and contact pieces extending from six straight sides thereof.

6. The grounding wire device of claim 5, wherein the grounding member includes contact pieces engageable with a peripheral surface of the hexagonal nut, a through-hole via which an insulator of the spark plug passes, and a grounding strip extending out of the engine cylinder head.

7. A ground wiring device for a spark plug which generates electric discharges between a center electrode and an external electrode and is attached to an engine cylinder head via a screwed part of a spark plug housing near the external electrode, the ground wiring device comprising:

a grounding member attached to a spark plug housing and shaped to be engageable with and disengageable from a hexagonal nut of the spark plug housing; and a grounding wire connecting the grounding member to a negative electrode of a battery, wherein the grounding member includes a hexagonal top whose shape and size are substantially identical to those of the hexagonal nut, the hexagonal top having through-hole at a center thereof for the spark plug housing, and three contact pieces extending from every two straight sides thereof.

8. The grounding wire device of claim 7, wherein the grounding member includes contact pieces engageable with a peripheral surface of the hexagonal nut, a through-hole via which an insulator of the spark plug passes, and a grounding strip extending out of the engine cylinder head.

9. A ground wiring method comprising:

attaching a grounding member on a housing of a spark plug which is installed in an engine cylinder head at a screwed part of the spark plug housing near an external housing and which generates discharges between a center electrode and an external electrode, the grounding member being shaped to be engageable with and disengageable from a hexagonal nut of the spark plug housing, wherein the grounding member includes a hexagonal top whose shape and size are substantially identical to those of the hexagonal nut, the hexagonal top having a through-hole at a center thereof for the spark plug housing, and contact pieces extending from six straight sides thereof; and connecting the grounding member to a negative electrode of a battery using a grounding wire.

10. A ground wiring method comprising:

attaching a grounding member on a housing of a spark plug which is installed in an engine cylinder head at a screwed part of the spark plug housing near an external housing and which generates discharges between a center electrode and an external electrode, the grounding member being shaped to be engageable with and disengageable from a hexagonal nut of the spark plug housing, wherein the grounding member includes a hexagonal top whose shape and size are substantially identical to those of the hexagonal nut, the hexagonal top having a through-hole at a center thereof for the spark plug housing, and contact pieces extending from every two straight sides thereof; and connecting the grounding member to a negative electrode of a battery using a grounding wire.

* * * * *